US006934622B2

(12) United States Patent
Sisken

(10) Patent No.: US 6,934,622 B2
(45) Date of Patent: Aug. 23, 2005

(54) INTERNAL COMBUSTION ENGINE WITH $NO_X$ ADSORBER

(75) Inventor: Kevin Dean Sisken, Saline, MI (US)

(73) Assignee: Detroit Diesel Corporation, Detroit, MI (US)

( * ) Notice: Subject to any disclaimer, the term of this patent is extended or adjusted under 35 U.S.C. 154(b) by 37 days.

(21) Appl. No.: 10/700,903

(22) Filed: Nov. 4, 2003

(65) Prior Publication Data

US 2005/0091967 A1 May 5, 2005

(51) Int. Cl.[7] ..... G06G 7/70

(52) U.S. Cl. ..... 701/111; 701/103; 701/108; 701/114; 60/274; 60/285; 60/286

(58) Field of Search ..... 701/110, 103, 108, 701/114; 60/285, 286, 295, 301, 302, 303, 60/274, 297

(56) References Cited

U.S. PATENT DOCUMENTS 4,359,862 A 11/1982 Virk et al.
4,505,106 A 3/1985 Frankenberg et al.
6,105,365 A * 8/2000 Deeba et al. ..... 60/274
6,442,933 B2 9/2002 Rusch
6,523,342 B2 2/2003 Küper et al.
6,735,940 B2 * 5/2004 Stroia et al. ..... 60/286
6,779,339 B1 * 8/2004 Laroo et al. ..... 60/297
2004/0040287 A1 * 3/2004 Beutel et al. ..... 60/285

* cited by examiner

*Primary Examiner*—Tony M. Argenbright
*Assistant Examiner*—Johnny H. Hoang
(74) *Attorney, Agent, or Firm*—Brooks Kushman P.C.

(57) ABSTRACT

An internal combustion engine includes first and second exhaust paths, and a first $NO_x$ adsorber located in the first exhaust path. A flow control valve controls the relative amounts of exhaust gas flowing through the first and second exhaust paths. A first injector injects a reductant into the exhaust gas stream. The injector is located so as to inject the reductant at a location adjacent to the flow control valve to cause mixing of the reductant and the exhaust gas and to allow regeneration of the first $NO_x$ adsorber.

9 Claims, 3 Drawing Sheets

INTERNAL COMBUSTION ENGINE WITH $NO_X$ ADSORBER

BACKGROUND OF THE INVENTION

1. Field of the Invention

The present invention relates to an internal combustion engine that includes a $NO_x$ adsorber.

2. Background Art

The heavy-duty engine business is extremely competitive. Increasing demands are being placed on engine manufacturers to design and build engines that provide better engine performance, improved reliability, and greater durability while meeting more stringent emission and noise requirements. One approach to meet more stringent emission requirements is to utilize a $NO_x$ adsorber. $NO_x$ are believed to be an environmental hazard, and are created when combustion temperatures become excessive. $NO_x$ are a particular concern in the turbocharged diesel engine.

A $NO_x$ adsorber or $NO_x$ trap is an aftertreatment device that stores or adsorbs $NO_x$ under lean conditions. Periodically, the $NO_x$ adsorber must be regenerated in order to continue collecting the $NO_x$ emissions. Under rich conditions, the $NO_x$ adsorber catalytically reduces the stored $NO_x$. In a typical arrangement for a diesel engine, a post injection of a reductant such as diesel fuel directly into the exhaust gas creates the rich conditions required for $NO_x$ adsorber regeneration. In one arrangement, three seconds of regeneration are required for each one minute of $NO_x$ adsorber operation.

For good regeneration, it is desired that the fuel (or other injected substance) be well mixed with the exhaust flow before entering the aftertreatment device. To improve the mixing, the current practice is to inject at an elbow, allow a long length of piping after the fuel is injected before entering the aftertreatment device, or a combination of these or other mixing schemes. Further background information may be found in U.S. Pat. Nos. 4,505,106; 6,442,933; 6,523,342; and 4,359,862.

For the foregoing reasons, there is a need to address the issue of mixing the reductant with the exhaust gas before entering the aftertreatment device.

SUMMARY OF THE INVENTION

It is, therefore, an object of the present invention to provide an improved internal combustion engine with a $NO_x$ adsorber wherein the reductant is injected at a location slightly upstream, slightly downstream, or directly in the flow control valve to improve mixing of the reductant and the exhaust gas before entering the $NO_x$ adsorber. The pressure drop across the flow control valve results in turbulence that improves mixing of the injected liquid or gas reductant with the engine exhaust gas. Advantageously, good mixing can be achieved in a relatively short distance, which may result in aftertreatment device performance benefits and packaging benefits. The flow control valve controls the relative amounts of exhaust gas mixture that flow to the $NO_x$ adsorber and that are diverted to an alternate path.

In carrying out the above object, an internal combustion engine is provided. The internal combustion engine has a plurality of cylinders. The engine includes an intake manifold and an exhaust manifold. The engine further comprises a first exhaust path for receiving and routing exhaust gases, a first $NO_x$ adsorber located in the first exhaust path, and a second exhaust path for receiving and routing exhaust gases. The engine further comprises a flow control valve between the exhaust manifold and the first and second exhaust paths for controlling the relative amounts of exhaust gas flowing through the first and second exhaust paths. The engine further comprises a first injector for injecting a reductant into the exhaust gas stream. The first injector is located so as to inject the reductant at a location adjacent to the flow control valve to cause mixing of the reductant and the exhaust gas and to allow regeneration of the first $NO_x$ adsorber.

It is appreciated that the reductant may or may not be fuel. It is appreciated that the flow control valve may be implemented in any suitable way that controls the relative amounts of exhaust gas flowing through the first and second exhaust paths. That is, the term "flow control valve" encompasses any arrangement using at least one flow control valve for controlling the relative amounts of exhaust gas flowing through the first and second exhaust paths. It is appreciated that the reductant injection adjacent to the flow control valve may occur at a location slightly upstream, slightly downstream, or directly in the flow control valve. Certain valve and injector arrangements route a lesser amount of exhaust gas to the $NO_x$ adsorber during regeneration than during normal operation. This approach allows a corresponding reduced amount of reductant to be injected. In a case where the reductant is fuel, such an approach limits the negative impact on fuel economy associated with the $NO_x$ adsorber regeneration process.

In some embodiments, the engine further comprises a second $NO_x$ adsorber located in the second exhaust path, and a second injector for injecting a reductant into the exhaust gas stream. The second injector is located so as to inject the reductant at a location adjacent to the control valve to cause mixing of the reductant and the exhaust gas and to allow regeneration of the second $NO_x$ adsorber. Using multiple $NO_x$ adsorbers reduces the overall $NO_x$ level passed to the environment because only one $NO_x$ adsorber is regenerated at a time while remaining adsorber(s) remain active, and only a small portion of the total exhaust gas is routed to the regenerating $NO_x$ adsorber while routing the larger remaining portion of the exhaust gas to the active $NO_x$ adsorber(s). Again, it is appreciated that the invention comprehends the concept of one or more $NO_x$ adsorbers and various flow control valve arrangements that control the relative amounts of exhaust gas flowing through the various exhaust paths with a flow control valve improving the mixing of the exhaust gas and the reductant.

Further, in carrying out the present invention, an internal combustion engine with a plurality of cylinders is provided. The engine includes an intake manifold and an exhaust manifold. The engine further comprises a first exhaust path for receiving and routing exhaust gases, a first $NO_x$ adsorber located in the first exhaust path, and a second exhaust path for receiving and routing exhaust gases. The engine further comprises a first flow control valve between the exhaust manifold and the first exhaust path and a second flow control valve between the exhaust manifold and the second exhaust path. The first and second flow control valves control the relative amounts of exhaust gas flowing through the first and second exhaust paths. The engine further comprises a first injector for injecting a reductant into the exhaust gas stream. The first injector is located so as to inject the reductant at a location adjacent to the first flow control valve to cause mixing of the reductant and the exhaust gas and to allow regeneration of the first $NO_x$ adsorber.

In some embodiments, the engine further comprises a second $NO_x$ adsorber located in the second exhaust path and a second injector. The second injector is for injecting a reductant into the exhaust gas stream. The second injector is located so as to inject the reductant at a location adjacent to the second flow control valve to cause mixing of the reductant and the exhaust gas and to allow regeneration of the second $NO_x$ adsorber.

Still further, in carrying out the present invention, a method is provided. The method is for use in an internal combustion engine including a first $NO_x$ adsorber and a first injector. The method comprises operating the engine in an active mode, and, subsequently, operating the engine in a regenerative mode. In the active mode, exhaust gas flows through the first exhaust path and then through the first $NO_x$ adsorber such that the first $NO_x$ adsorber adsorbs $NO_x$ from the exhaust gas. In the regenerative mode, a flow control valve causes a reduced amount of the exhaust gas to flow through the first exhaust path and through the first $NO_x$ adsorber and the reductant is injected into the reduced amount of the exhaust gas at a location adjacent to the flow control valve. This causes mixing of the reductant and the exhaust gas such that the first $NO_x$ adsorber catalytically reduces the previously adsorbed $NO_x$ to regenerate the first $NO_x$ adsorber.

Still further, in carrying out the present invention, a method is provided. The method is for use in an internal combustion engine including a first $NO_x$ adsorber and a first injector, and a second $NO_x$ adsorber and a second injector. The method comprises operating the engine in an active mode, subsequently, operating the engine in a first regenerative mode, and, subsequently, operating the engine in a second regenerative mode. In the active mode, exhaust gas flows through the first exhaust path and through the first $NO_x$ adsorber such that the first $NO_x$ adsorber adsorbs $NO_x$ from the exhaust gas. Further, in the active mode, exhaust gas flows through the second exhaust path and through the second $NO_x$ adsorber such that the second $NO_x$ adsorber adsorbs $NO_x$ from the exhaust gas.

In the first regenerative mode, a flow control valve causes a reduced amount of the exhaust gas to flow through the first exhaust path and through the first $NO_x$ adsorber. The reductant is injected into the reduced amount of the exhaust gas at a location adjacent to the flow control valve. This causes mixing of the reductant and the exhaust gas such that the first $NO_x$ adsorber catalytically reduces the previously adsorbed $NO_x$ to regenerate the first $NO_x$ adsorber.

In the second regenerative mode, a reduced amount of the exhaust gas flows through the second exhaust path and through the second $NO_x$ adsorber. The reductant is injected into the reduced amount of the exhaust gas at a location adjacent to a flow control valve. This causes mixing of the reductant and the exhaust gas such that the second $NO_x$ adsorber catalytically reduces the previously adsorbed $NO_x$ to regenerate the second $NO_x$ adsorber.

In a preferred method, the second adsorber remains active while the first adsorber is regenerated in the first regenerative mode. Further, preferably, the first adsorber remains active while the second adsorber is regenerated in the second regenerative mode.

The above object and other objects, features, and advantages of the present invention are readily apparent from the following detailed description of the preferred embodiments when taken in connection with the accompanying drawings.

DETAILED DESCRIPTION OF THE PREFERRED EMBODIMENTS

Figure 1:
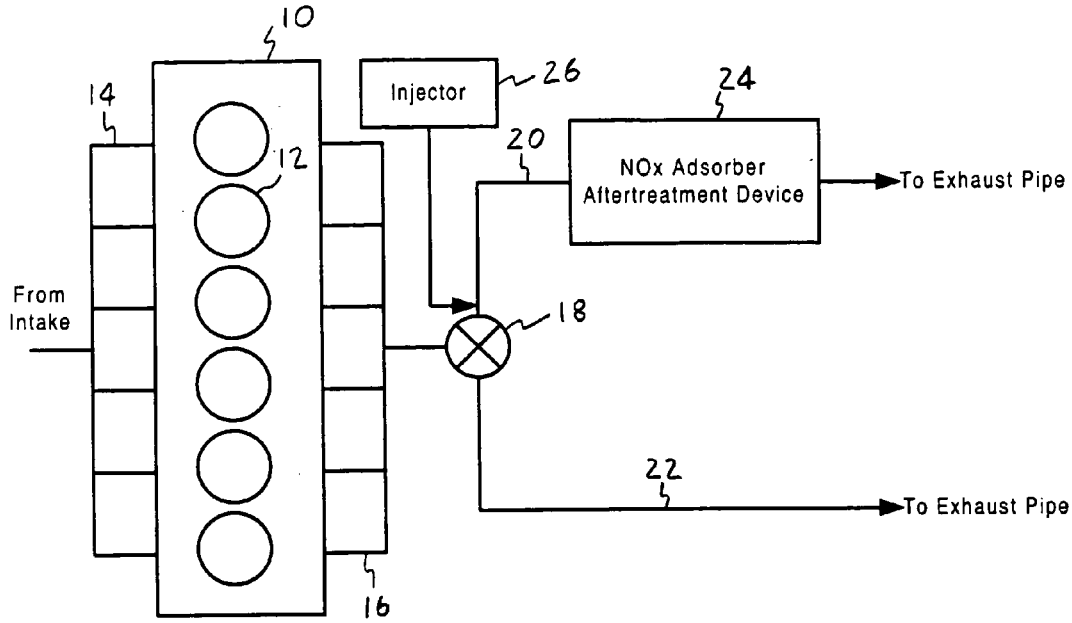
FIG. 1 illustrates an engine of the present invention including a single flow control valve and a single $NO_x$ adsorber.

FIG. 1 illustrates an internal combustion engine including an engine block 10 with a plurality of cylinders 12. The illustrated engine is a compression-ignition internal combustion engine such as a heavy-duty diesel engine. Cylinders 12 receive pressurized fuel from a fuel supply in a known manner. The engine includes an intake manifold 14 and an exhaust manifold 16. A flow control valve 18 is located between exhaust manifold 16 and first and second exhaust paths 20 and 22, respectively. Flow control valve 18 controls the relative amounts of exhaust gas flowing through the first exhaust path 20 and the second exhaust path 22. A $NO_x$ adsorber 24 is located in first exhaust path 20. An injector 26 is for injecting a reductant such as fuel into the exhaust gas stream. Injector 26 injects the reductant at a location adjacent to flow control valve 18 to cause mixing of the reductant and the exhaust gas and to allow regeneration of $NO_x$ adsorber 24.

In operation, when $NO_x$ adsorber 24 is active, substantially all exhaust flow is directed by flow control valve 18 to first exhaust path 20 and in the presence of the lean exhaust gas mixture, $NO_x$ adsorber 24 adsorbs or traps $NO_x$. Periodically, $NO_x$ adsorber 24 must be regenerated. Regeneration takes place by injector 26 injecting the reductant into first exhaust path 20 to create a richer exhaust gas mixture that causes $NO_x$ adsorber 24 to catalytically reduce the stored $NO_x$. During the regeneration process, flow control valve 18 directs only a reduced portion of the total exhaust gas flow to first exhaust path 20 while diverting the remaining portion of exhaust gas flow to second exhaust path 22. In this way, the amount of reductant required to create the rich mixture for regeneration is reduced. Particularly, when the reductant is fuel, this approach reduces the negative effects on fuel economy associated with regeneration of $NO_x$ adsorber 24. It may be desirable to modify the fuel injection strategy during regeneration to reduce the amount of $NO_x$ diverted through second exhaust path 22 where there is no adsorber.

Figure 2:
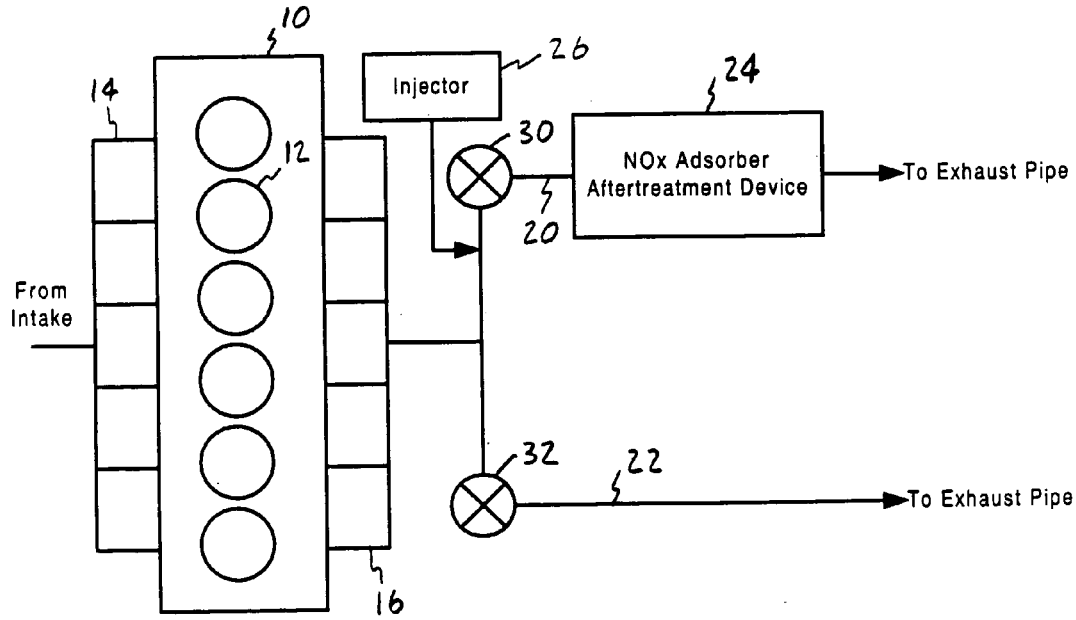
FIG. 2 illustrates an engine of the present invention including two flow control valves and a single $NO_x$ adsorber.

FIG. 2 illustrates an embodiment similar to the embodiment of FIG. 1 but including first and second control valves 30 and 32, respectively. Flow control valves 30 and 32 control the relative amounts of exhaust gas flowing through first exhaust path 20 and second exhaust path 22.

Figure 3:
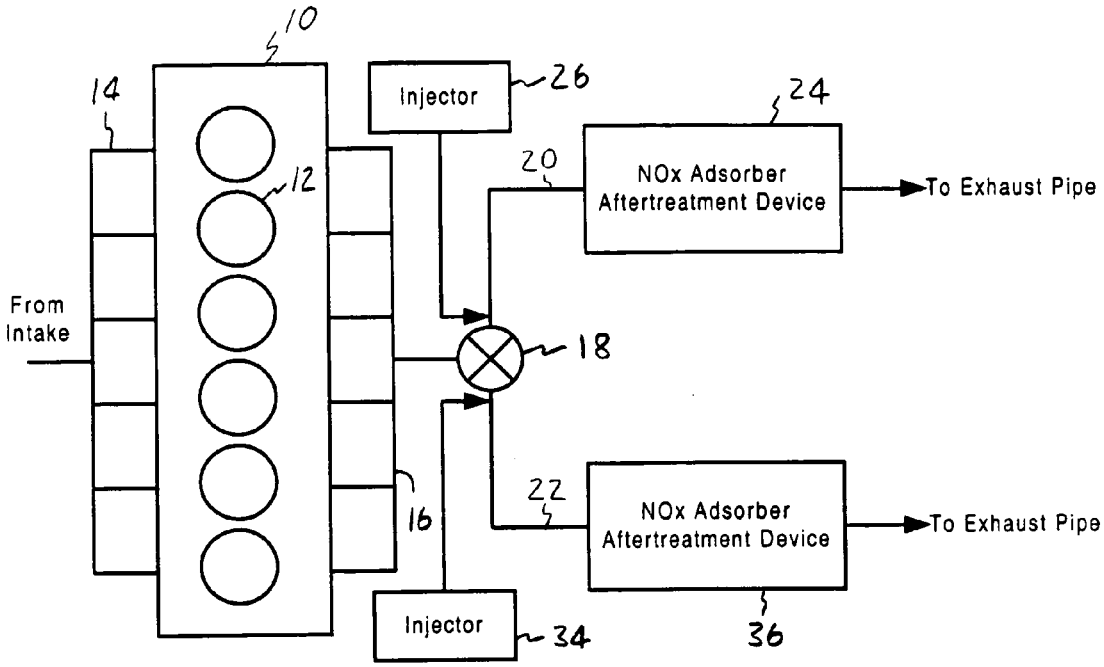
FIG. 3 illustrates an engine of the present invention including a single flow control valve and two $NO_x$ adsorbers.

FIG. 3 illustrates an embodiment including a single flow control valve 18 and first and second $NO_x$ adsorbers 24 and 36, respectively. First and second injectors 26 and 34, respectively, are associated with the first and second $NO_x$ adsorbers 24 and 36, respectively. Flow control valve 18 controls the relative amounts of exhaust gas flowing through first exhaust path 20 and second exhaust path 22. This embodiment allows $NO_x$ adsorbers 24 and 36 to be alternately regenerated such that the main portion of the exhaust gas flow is always being treated by one or the other $NO_x$ adsorber. For example, when both $NO_x$ adsorber 24 and $NO_x$ adsorber 36 are active, flow control valve 18 may pass half of the total exhaust flow to each of first and second exhaust paths 20 and 22, respectively. When $NO_x$ adsorber 24 requires regeneration, flow control valve 18 may divert a majority of the exhaust gas to $NO_x$ adsorber 36 for after-treatment while sending only a reduced portion of the exhaust gas flow along first path 20 to $NO_x$ adsorber 24. In this way, the amount of reductant injected by injector 26 to create the required rich mixture is reduced which has significant effects on fuel economy when the reductant is fuel.

Figure 4:
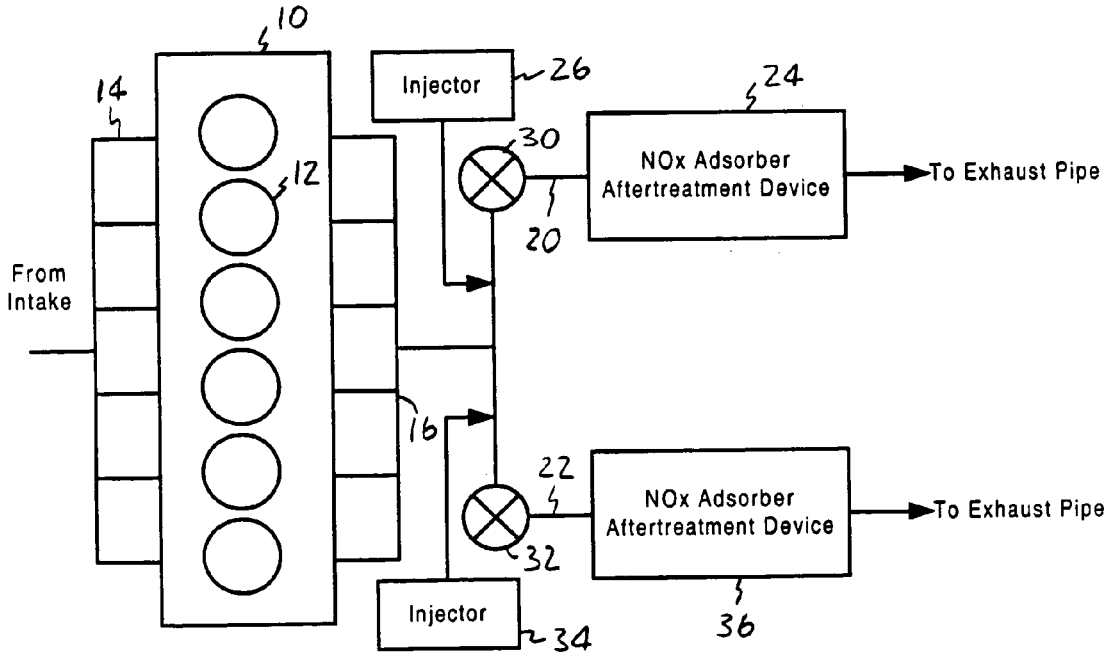
FIG. 4 illustrates an engine of the present invention including two flow control valves and two $NO_x$ adsorbers.

FIG. 4 illustrates an embodiment similar to the embodiment of FIG. 3 but including first and second control valves 30 and 32, respectively. Flow control valves 30 and 32 control the relative amounts of exhaust gas flowing through the first exhaust path 20 and second exhaust path 22.

Figure 5:
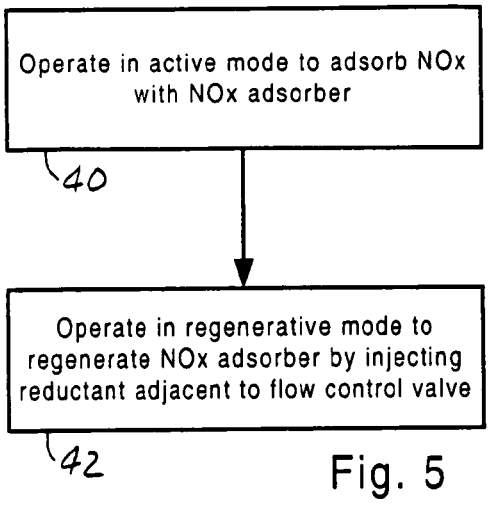
FIG. 5 illustrates a method of the present invention.

FIG. 5 illustrates a method of the present invention. At block 40, the engine is operated in an active mode where exhaust gas flows through a first exhaust path and through a first $NO_x$ adsorber such that the first $NO_x$ adsorber adsorbs $NO_x$ from the exhaust gas. At block 42, subsequently, the engine is operated in a regenerative mode. In the regenerative mode, a reduced amount of the exhaust gas flows through the first exhaust path and through the first $NO_x$ adsorber, and the reductant is injected into the reduced amount of the exhaust gas at a location adjacent to a flow control valve to cause mixing of the reductant and the exhaust gas. This causes the first $NO_x$ adsorber to catalytically reduce the previously adsorbed $NO_x$ to regenerate the first $NO_x$ adsorber.

Figure 6:
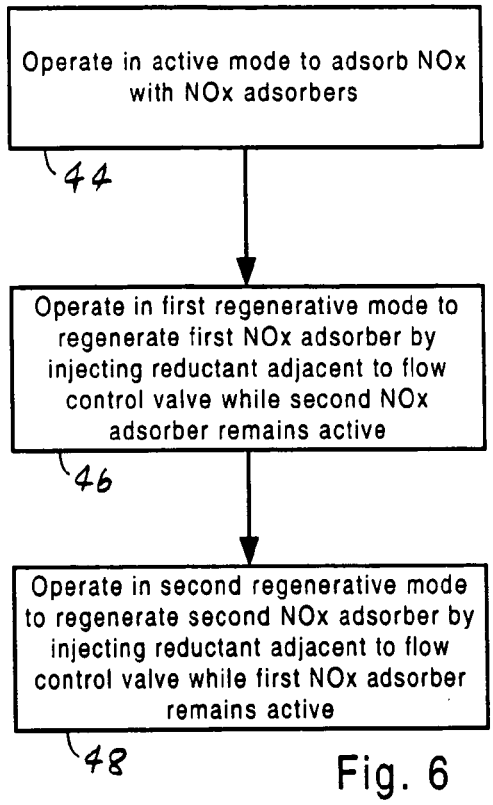
FIG. 6 illustrates a method of the present invention utilizing first and second $NO_x$ adsorbers.

In FIG. 6, a method involving two $NO_x$ adsorbers is illustrated. At block 44, the engine is operated in the active mode, adsorbing $NO_x$ with both $NO_x$ adsorbers. At block 46, the engine is operated in a first regenerative mode to regenerate the first $NO_x$ adsorber by injecting reductant adjacent to a flow control valve while the second $NO_x$ adsorber remains active. At block 48, the engine is operated in a second regenerative mode to regenerate the second $NO_x$ adsorber by injecting reductant adjacent to a flow control valve while the first $NO_x$ adsorber remains active.

While embodiments of the invention have been illustrated and described, it is not intended that these embodiments illustrate and describe all possible forms of the invention. Rather, the words used in the specification are words of description rather than limitation, and it is understood that various changes may be made without departing from the spirit and scope of the invention.

What is claimed is:

1. An internal combustion engine with a plurality of cylinders, the engine including an intake manifold and an exhaust manifold, the engine further comprising:

a first exhaust path for receiving and routing exhaust gases;

a first $NO_x$ adsorber located in the first exhaust path;

a second exhaust path for receiving and routing exhaust gases;

a flow control valve between the exhaust manifold and the first and second exhaust paths for controlling the relative amounts of exhaust gas flowing through the first and second exhaust paths; and a first injector for injecting a reductant into the exhaust gas stream, the first injector being located so as to inject the reductant at a location immediately adjacent to the flow control valve;

wherein there is a pressure drop across the flow control valve that results in turbulent flow in a region immediately adjacent to the flow control valve that includes the reductant injection location, thereby causing mixing of the reductant and the exhaust gas in a relatively short distance and to allow regeneration of the first $NO_x$ adsorber.

2. The internal combustion engine of claim 1 wherein the first injector is located so as to inject the reductant at a location immediately downstream of the flow control valve along the first exhaust path.

3. The internal combustion engine of claim 1 further comprising:

a second $NO_x$ adsorber located in the second exhaust path; and a second injector for injecting a reductant into the exhaust gas stream, the second injector being located so as to inject the reductant at a location immediately adjacent to the flow control valve;

wherein there is a pressure drop across the flow control valve that results in turbulent flow in a region immediately adjacent to the flow control valve that includes the reductant injection location, thereby causing mixing of the reductant and the exhaust gas in a relatively short distance and to allow regeneration of the second $NO_x$ adsorber.

4. The internal combustion engine of claim 3 wherein the second injector is located so as to inject the reductant at a location immediately downstream of the flow control valve along the second exhaust path.

5. The internal combustion engine of claim 4 wherein the first injector is located so as to inject the reductant at a location immediately downstream of the flow control valve along the first exhaust path.

6. In an internal combustion engine with a plurality of cylinders, the engine including an intake manifold and an exhaust manifold, the engine further including, a first exhaust path for receiving and routing exhaust gases, a first $NO_x$ adsorber located in the first exhaust path, a second exhaust path for receiving and routing exhaust gases, at least one flow control valve between the exhaust manifold and the first and second exhaust paths for controlling the relative amounts of exhaust gas flowing through the first and second exhaust paths, and a first injector for injecting a reductant into the exhaust gas stream, the first injector being located so as to inject the reductant at a location immediately adjacent to a flow control valve, wherein there is a pressure drop across the flow control valve that results in turbulent flow in a region immediately adjacent to the flow control valve that includes the reductant injection location, thereby causing mixing of the reductant and the exhaust gas in a relatively short distance and to allow regeneration of the first $NO_x$ adsorber, the method comprising:

operating the engine in an active mode wherein exhaust gas flows through the first exhaust path and through the first $NO_x$ adsorber such that the first $NO_x$ adsorber adsorbs $NO_x$ from the exhaust gas; and subsequently, operating the engine in a regenerative mode wherein a reduced amount of the exhaust gas flows through the first exhaust path and through the first $NO_x$ adsorber and wherein the reductant is injected into the reduced amount of the exhaust gas at a location immediately adjacent to a flow control valve, wherein there is a pressure drop across the flow control valve that results in turbulent flow in a region immediately adjacent to the flow control valve that includes the reductant injection location, thereby causing mixing of the reductant and the exhaust gas in a relatively short distance such that the first $NO_x$ adsorber catalytically reduces the previously adsorbed $NO_x$ to regenerate the first $NO_x$ adsorber.

7. In an internal combustion engine with a plurality of cylinders, the engine including an intake manifold and an exhaust manifold, the engine further including, a first exhaust path for receiving and routing exhaust gases, a first $NO_x$ adsorber located in the first exhaust path, a second exhaust path for receiving and routing exhaust gases, a second $NO_x$ adsorber located in the second exhaust path, at least one flow control valve between the exhaust manifold and the first and second exhaust paths for controlling the relative amounts of exhaust gas flowing through the first and second exhaust paths, a first injector for injecting a reductant into the exhaust gas stream, and a second injector for injecting a reductant into the exhaust gas stream, the first injector being located so as to inject the reductant at a location immediately adjacent to a flow control valve, wherein there is a pressure drop across the flow control valve that results in turbulent flow in a region immediately adjacent to the flow control valve that includes the reductant injection location, thereby causing mixing of the reductant and the exhaust gas in a relatively short distance and to allow regeneration of the first $NO_x$ adsorber, the second injector being located so as to inject the reductant at a location immediately adjacent to a flow control valve, wherein there is a pressure drop across the flow control valve that results in turbulent flow in a region immediately adjacent to the flow control valve that includes the reductant injection location, thereby causing mixing of the reductant and the exhaust gas in a relatively short distance and to allow regeneration of the second $NO_x$ adsorber, the method comprising:

operating the engine in an active mode wherein exhaust gas flows through the first exhaust path and through the first $NO_x$ adsorber such that the first $NO_x$ adsorber adsorbs $NO_x$ from the exhaust gas and exhaust gas flows through the second exhaust path and through the second $NO_x$ adsorber such that the second $NO_x$ adsorber adsorbs $NO_x$ from the exhaust gas;

subsequently, operating the engine in a first regenerative mode wherein a reduced amount of the exhaust gas flows through the first exhaust path and through the first $NO_x$ adsorber and wherein the reductant is injected into the reduced amount of the exhaust gas at a location immediately adjacent to a flow control valve, wherein there is a pressure drop across the flow control valve that results in turbulent flow in a region immediately adjacent to the flow control valve that includes the reductant injection location, thereby causing mixing of the reductant and the exhaust gas in a relatively short distance such that the first $NO_x$ adsorber catalytically reduces the previously adsorbed $NO_x$ to regenerate the first $NO_x$ adsorber; and subsequently, operating the engine in a second regenerative mode wherein a reduced amount of the exhaust gas flows through the second exhaust path and through the second $NO_x$ adsorber and wherein the reductant is injected into the reduced amount of the exhaust gas at a location immediately adjacent to a flow control valve, wherein there is a pressure drop across the flow control valve that results in turbulent flow in a region immediately adjacent to the flow control valve that includes the reductant injection location, thereby causing mixing of the reductant and the exhaust gas in a relatively short distance such that the second $NO_x$ adsorber catalytically reduces the previously adsorbed $NO_x$ to regenerate the second $NO_x$ adsorber.

8. The method of claim 7 further comprising:

when the engine is operated in the first regenerative mode and the reduced amount of the exhaust gas flows through the first exhaust path to regenerate the first adsorber, routing a remainder of the exhaust gas through the second exhaust path such that the second adsorber remains active.

9. The method of claim 7 further comprising:

when the engine is operated in the second regenerative mode and the reduced amount of the exhaust gas flows through the second exhaust path to regenerate the second adsorber, routing a remainder of the exhaust gas through the first exhaust path such that the first adsorber remains active.

* * * * *